US011306715B2

(12) United States Patent
Deichmann et al.

(10) Patent No.: US 11,306,715 B2
(45) Date of Patent: Apr. 19, 2022

(54) SCREW-SPINDLE PUMP, FUEL DELIVERY ASSEMBLY, AND FUEL DELIVERY UNIT

(71) Applicant: Vitesco Technologies GmbH, Hannover (DE)

(72) Inventors: Johannes Deichmann, Rotenburg (DE); Tim Gonnermann, Wehretal (DE); Marc Völker, Magdeburg (DE)

(73) Assignee: Vitesco Technologies GmbH, Hannover (DE)

( * ) Notice: Subject to any disclaimer, the term of this patent is extended or adjusted under 35 U.S.C. 154(b) by 165 days.

(21) Appl. No.: 16/624,745

(22) PCT Filed: Jun. 25, 2018

(86) PCT No.: PCT/EP2018/066948
§ 371 (c)(1),
(2) Date: Dec. 19, 2019

(87) PCT Pub. No.: WO2019/002203
PCT Pub. Date: Jan. 3, 2019

(65) Prior Publication Data

US 2021/0164468 A1 Jun. 3, 2021

(30) Foreign Application Priority Data

Jun. 27, 2017 (DE) ..... 10 2017 210 767.7

(51) Int. Cl.
*F01C 21/10* (2006.01)
*F01C 21/02* (2006.01)
(Continued)

(52) U.S. Cl.
CPC ..... *F04C 2/16* (2013.01); *F04C 15/0049* (2013.01); *F04C 2210/1044* (2013.01); *F04C 2230/60* (2013.01); *F04C 2240/30* (2013.01)

(58) Field of Classification Search
CPC .... F04C 2/16; F04C 15/0049; F04C 2280/02; F01C 21/102
See application file for complete search history.

(56) References Cited

U.S. PATENT DOCUMENTS 4,940,394 A * 7/1990 Gibbons ..... F01C 21/102 417/283
5,123,821 A 6/1992 Willibald et al.
(Continued)

FOREIGN PATENT DOCUMENTS

DE 10 2014 102 390 3/2015
EP 0 323 834 7/1989
GB 358843 A * 10/1931 ..... F04C 2/088

OTHER PUBLICATIONS

English GB-358843, Nov. 15, 2021.*
(Continued)

*Primary Examiner* — Deming Wan
(74) *Attorney, Agent, or Firm* — Cozen O'Connor

(57) ABSTRACT

A screw-spindle pump includes: a first (drive) screw spindle and a second (running) screw spindle that runs oppositely with respect to the first screw spindle; and a pump housing configured to receive the first and second screw spindles. The first and second screw spindles form, together with at least the pump housing, delivery chambers, which move from a suction side of the pump to a pressure side of the pump due to a rotation of the first and second screw spindles. The pump housing has a first abutment insert for the first screw spindle and a second abutment insert for the second screw spindle, and at least one of the first and second abutment inserts is set angled with respect to a first plane of the pump, to counteract operationally induced crossing of the first and second screw spindles.

17 Claims, 2 Drawing Sheets

(51) Int. Cl.
*F04C 2/16* (2006.01)
*F04C 15/00* (2006.01)

(56) References Cited

U.S. PATENT DOCUMENTS

2003/0037823 A1* 2/2003 Pickelman ..... F16K 15/026
137/543.13
2009/0232691 A1* 9/2009 Van Leuven ..... F04C 18/16
418/201.1
2016/0072362 A1* 3/2016 Kube ..... H02K 1/141
310/67 R

OTHER PUBLICATIONS

Office Action dated Mar. 12, 2021 issued in Chinese Patent Application No. 201880037849.2.
International Search Report issued in corresponding PCT Application PCT/EP2018/066948.
Written Opinion issued in corresponding PCT Application PCT/EP2018/066948.
Office Action issued in corresponding German Application No. 10 2017 210 767.7.

* cited by examiner

SCREW-SPINDLE PUMP, FUEL DELIVERY ASSEMBLY, AND FUEL DELIVERY UNIT

CROSS REFERENCE TO RELATED APPLICATIONS

This is a U.S. national stage of International application No. PCT/EP2018/066948, filed on Jun. 25, 2018, which claims priority to German Application No. 10 2017 210 767.7, filed Jun. 27, 2017, the content of each of which is incorporated herein by reference.

BACKGROUND OF THE INVENTION

1. Field of the Invention

The present invention relates to a screw-spindle pump, to a fuel delivery assembly comprising such a screw-spindle pump and to a fuel delivery unit comprising such a fuel delivery assembly, for use in vehicles, in particular in passenger motor vehicles and/or utility vehicles.

2. Description of the Prior Art

Screw-spindle pumps—also referred to as screw pumps—are positive displacement pumps whose displacement structure has the form of a spindle screw. Two oppositely running screw spindles which are formed with a threaded profiling engage into one another here and displace a delivery medium, which may for example be a fuel—for example gasoline or diesel fuel—for an internal combustion engine of a passenger motor vehicle and/or a utility vehicle. The combination of the spindle screws and a pump housing in which the screw spindles are arranged and guided is also referred to as a pump stage. The two screw spindles form, in combination with the pump housing, delivery chambers for the delivery medium. The delivery chambers travel from a suction side or inlet side to a pressure side or outlet side of the pump or pump stage as a consequence of a rotation of the screw spindles, and thereby transport the sucked-in delivery medium.

Within the context of the present disclosure, the terms pump and pump stage are to be understood as meaning one and the same object.

Pumps of this type are used, for example, in fuel delivery assemblies or fuel pumps of vehicles, in particular of passenger motor vehicles and/or utility vehicles. Within the context of the present disclosure, the terms fuel delivery assembly and fuel pump are to be understood as meaning one and the same object, which, in addition to a pump or pump stage, also comprises an electric motor as a drive.

Due to the pressure states established in the pump during operation, the screw spindles undergo axial displacement relative to the pump housing, and oblique positioning or crossing relative to one another and relative to the pump housing.

The prior art has disclosed pumps of the above-described type, which are provided on the suction side with a planar abutment surface against which the screw spindles abut and are thus supported. In this case, the planar abutment surface belongs to a cuboidal insert element composed of metal, which functions as an abutment element and is preferably arranged in a pump cover. By way of the insert element, an operationally induced axial displacement of the screws is intercepted.

The "driving" screw may in this case be supported on the pressure side against the pump housing via a coupling, whereas the "driven" screw may be supported on the pressure side via a peg which is injection molded on the pump housing. For the purpose of clarification, it should be mentioned here that these supports are generally to be understood in each case as being an emergency support. The actual support of the two screw spindles is, for operationally related reasons, realized on the suction side against an axial abutment provided on the housing side for this purpose.

Here, the planar abutment surface provided on the suction side ensures merely that the operationally induced axial displacement of the screws is intercepted. The oblique positioning or crossing of the screws on the other hand remains uninfluenced by this, however.

SUMMARY OF THE INVENTION

An object of one aspect of the present invention is to provide an improved pump of the above-described type, which also counteracts the oblique positioning or crossing of the screws.

This object may be achieved by a screw-spindle pump stage that includes at least two screw spindles, which include a drive spindle and a running spindle which runs oppositely with respect to the drive spindle, and a pump housing for receiving the two screw spindles.

Here, the two screw spindles form, at least in combination with the pump housing, delivery chambers, which move from a suction side or inlet side to a pressure side or outlet side of the pump as a consequence of a rotation of the screw spindles. Or, put differently, the delivery chambers move in the direction of the pressure side of the pump as a consequence of a rotation of the screw spindles.

In principle, it would also be possible for such screw spindles to form the delivery chambers in combination with a pump housing, with a pump cover and possibly with an additional element or insert element, wherein the additional element may be arranged within the pump housing and/or the pump cover.

The pump housing has in this case a first abutment for the drive spindle and a second abutment for the running spindle. Here, it is proposed that at least one of the two abutments is set at an angle with respect to a first plane of the pump, in order to counteract operationally induced oblique positioning or crossing of the two spindles.

Within the context of the present disclosure, an angular setting of an abutment is to be understood as meaning an inclination or pivoting of the abutment relative to a reference plane, wherein the reference plane is to be understood as being either a plane spanned by a longitudinal direction or longitudinal axis of the pump and a transverse direction or transverse axis of the pump, which is orthogonal thereto, or else a plane which is spanned by the longitudinal direction or longitudinal axis of the pump together with a further transverse direction or transverse axis of the pump, which is orthogonal thereto.

This makes it possible to reduce the gap between the screws along the intermeshing engagement portion, with the result that the "inner" leakage of the pump or pump stage is also reduced. This in turn has the result that the friction in those regions of the pump housing in which this oblique positioning or crossing is intercepted is reduced. This therefore also entails a reduction in the torque requirement of the pump. As a result, the efficiency of the pump is thereby improved in two ways.

According to one aspect of the present invention, the first abutment is set at a first angle, and the second abutment is set at a second angle, with respect to the first plane, in order to counteract the oblique positioning or crossing. In this case, the first angle may be formed oppositely in relation to the second angle. Furthermore, the two angles may be identical in terms of magnitude.

This makes it possible to further reduce the "inner" leakage and further improve the efficiency of the pump.

According to a further aspect of the present invention, in addition, at least one of the two abutments is set at an angle with respect to a second plane of the pump, which is orthogonal to the first plane of the pump, in order to counteract the oblique positioning or crossing of the two spindles in space.

This makes it possible to further reduce the "inner" leakage and further improve the efficiency of the pump.

According to a further aspect of the present invention, in addition, the first abutment is set at a third angle, and the second abutment is set at a fourth angle, with respect to the second plane, in order to counteract the oblique positioning or crossing. In this case, the third angle may be formed oppositely in relation to the fourth angle. Furthermore, the two angles may be identical in terms of magnitude.

This makes it possible to further reduce the "inner" leakage and further improve the efficiency of the pump.

According to a further aspect of the present invention, the pump housing has at least one insert, which functions as an abutment for the screw spindles and which has the first abutment and the second abutment and against which the screw spindles are supported.

According to a further aspect of the present invention, the pump housing has a first insert for the drive spindle and a second insert for the running spindle, wherein the first insert has the first abutment, and the second insert has the second abutment, for supporting the respective screw spindle.

Here, the insert may, for example, be of cuboidal, prismatic or round form. With regard to the shaping of the insert, however, numerous further variations are also conceivable. Here, a round insert means is to be understood as meaning a substantially cylindrical body, or cylinder, whose height is smaller in comparison with its width or with its diameter.

Here, it is advantageously possible for the insert to be provided with a peripheral shoulder for axial fixing with respect to the pump housing. Additionally or alternatively, the insert may also be provided with shaped elements for tangential fixing with respect to the pump housing. Here, the shaped elements are arranged over the periphery of the insert, for example in the form of straight tooth flanks. In principle, with regard to such shaped elements, the shaping is able to be configured in a highly varied manner and may encompass both straight and non-straight shapes.

The insert may in this case furthermore be formed from a ceramic, a metal or a plastic. Here, a ceramic or a metal is particularly characterized by its hardness, by which, as is known, it is possible for friction to be reduced and for wear resistance to be promoted.

According to a further aspect of the present invention, the pump housing may be supplemented by a pump cover, in which the first abutment and the second abutment are arranged. In this case, the insert may be arranged in the pump cover. The pump cover may in this case be regarded as a part for receiving the screw spindles that belongs to the pump housing.

The pump housing and/or the pump cover may in this case be formed as injection moldings/an injection molding.

Furthermore, the insert may have a receiver for an orientating structure, preferably in the form of a pressure-exerting pin, by way of which it is possible to orient the insert for the encapsulation to set an angular setting with respect to the longitudinal direction and/or the transverse direction of the pump.

Also proposed is a fuel delivery assembly which has an electric motor and has a screw-spindle pump of the above-described type which is driven by the electric motor.

A fuel delivery assembly for use in a fuel tank of a vehicle is also proposed. A "vehicle" is to be understood here as meaning any type of vehicle which has to be supplied with a liquid and/or gaseous fuel for operation, but in particular passenger motor vehicles and/or utility vehicles.

Here, the fuel delivery assembly comprises a fuel delivery assembly of the above-described type, and a swirl pot in which the fuel delivery assembly is arranged in order for fuel to be delivered from the swirl pot to an internal combustion engine.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will be discussed in detail in the following text with reference to the illustrations in the figures. Further advantageous refinements of the invention arise from the dependent claims and the description below of preferred embodiments. In the drawings:

DETAILED DESCRIPTION OF THE PRESENTLY PREFERRED EMBODIMENTS

Figure 1:
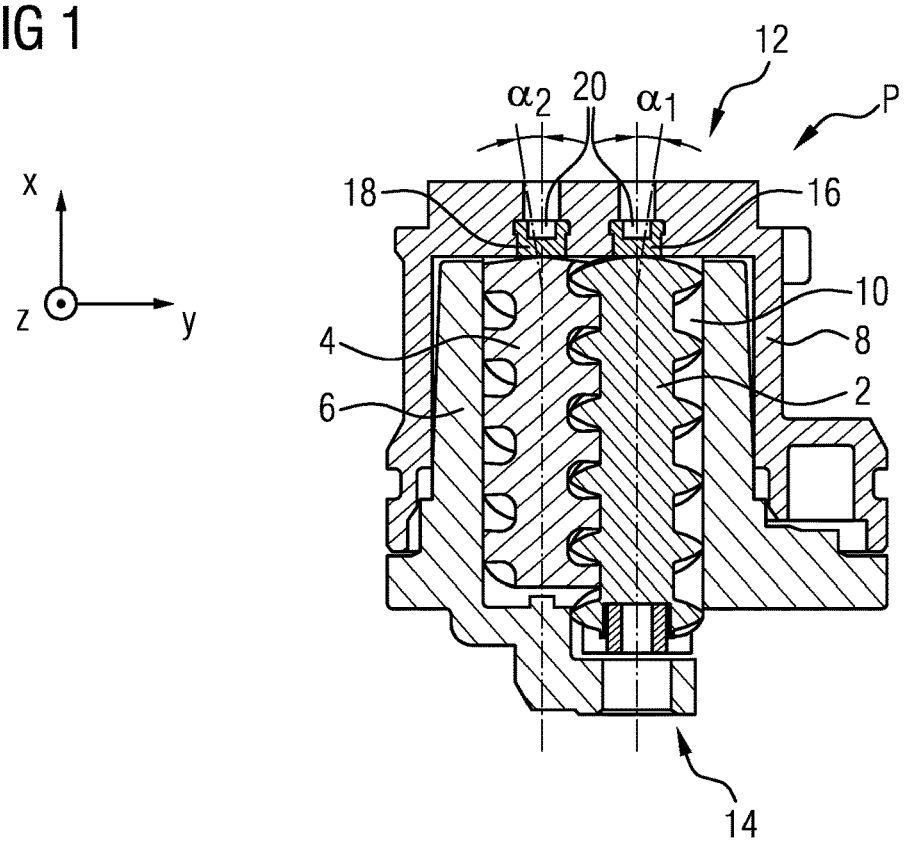
FIG. 1 shows a sectional illustration of a proposed screw-spindle pump.

FIG. 1 illustrates a screw-spindle pump or screw-spindle pump stage P, which comprises a drive spindle 2 and a running spindle 4, which runs oppositely with respect to the drive spindle 2. The pump P furthermore comprises a pump housing 6 which also has a pump cover 8 for receiving the two screw spindles 2, 4.

Here, the two screw spindles 2, 4 form, together with the pump housing 6, delivery chambers 10, which move from a suction side 12 to a pressure side 14 of the pump P as a consequence of a rotation of the screw spindles 2, 4. Or, put differently, the delivery chambers 10 move in the direction of the pressure side 14 as a consequence of a rotation of the screw spindles 2, 4.

Furthermore, two round inserts 16, 18, which function as abutment elements and which are formed from a ceramic, are arranged in the pump cover 8 and form abutment surfaces against which the two screw spindles 2, 4, for operationally related reasons, abut and are thus supported. The abutment surfaces may in this case be of planar or non-planar form, for example in the form of a formation of the respectively facing abutment surface that is concave with respect to the screw spindles.

The first insert (or the first abutment) 16 is in this case associated with the drive spindle 2, whereas the second insert (or the second abutment) 18 is associated with the running spindle 4.

Furthermore, these two abutments 16, 18 are each set at an angle with respect to a first plane X-Z and with respect to a second plane X-Y of the pump P, in order to counteract operationally induced crossing of the two spindles 2, 4. Here, the first plane X-Z is orthogonal to the second plane X-Y.

The first plane X-Z is in this case spanned by the longitudinal direction or longitudinal axis X-X of the pump or pump stage and a transverse direction or transverse axis Z-Z of the pump or pump stage, which is orthogonal thereto. By contrast, the second plane X-Y is spanned by the longitudinal direction or longitudinal axis X-X of the pump or pump stage and a further transverse direction or transverse axis Y-Y of the pump or pump stage, which is orthogonal thereto.

The first abutment 16 is set at a first angle $\alpha_1$ with respect to the first plane X-Z, and the second abutment 18 is set at a second angle $\alpha_2$ with respect to the first plane X-Z. Here, the first angle $\alpha_1$ is formed oppositely in relation to the second angle $\alpha_2$, with the two angles $\alpha_1$, $\alpha_2$ being identical in terms of magnitude, for example (cf. FIG. 1).

Also, the first abutment 16 is set at a third angle $\beta_1$ with respect to the second plane X-Y, and the second abutment 18 is set at a fourth angle $\beta_2$ with respect to the second plane X-Y. Here, the third angle $\beta_1$ is formed oppositely in relation to the fourth angle $\beta_2$, with the two angles $\beta_1$, $\beta_2$ being identical in terms of magnitude, for example (cf. FIG. 3B).

Figure 2:
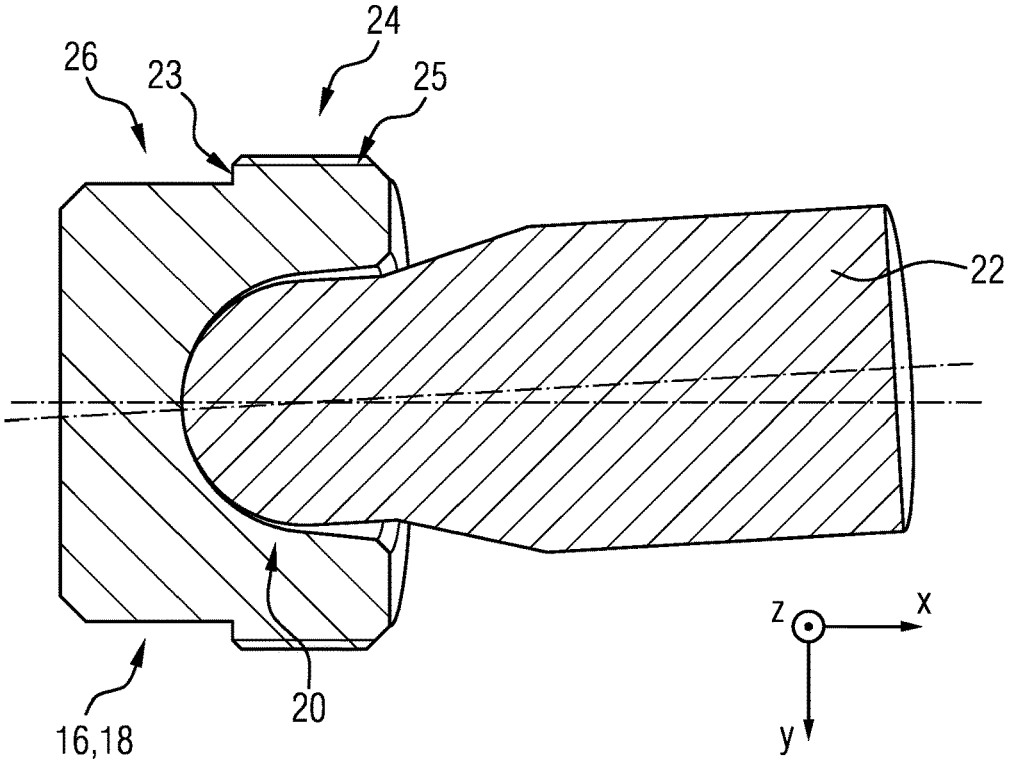
FIG. 2 shows a round insert means or abutment element together with a pressure-exerting pin.

The pump housing 6 and the pump cover 8 are formed as injection moldings. The two inserts 16, 18 with the associated abutments are encapsulated during the production by way of injection molding of the pump cover 8. Before the inserts are encapsulated, however, they undergo the above-described spatial orientation (cf. angles $\alpha_1$, $\alpha_2$, $\beta_1$, $\beta_2$). For this purpose, the two inserts 16, 18 each contain a receiver (or recess) 20 for orientation structure, preferably in the form of a pressure-exerting pin 22 (cf. FIG. 2), by way of which it is possible to orient the respective inserts for the encapsulation—using an abutment structure (not illustrated here), against which the respective inserts 16, 18 are able to be abutted—in order to set or to allow the angular setting with respect to the first plane X-Z and the second plane X-Y of the pump P. After the encapsulation, the two pressure-exerting pins 22 are removed from the pump cover 8, so that the two receivers or recesses 20 are formed. In this case, the receiver 20 may be of hemispherical form, with a short section which widens in an outwardly conical manner adjoining the hemisphere shape (cf. FIG. 2).

Here, an aforementioned round insert 16, 18 is to be understood as meaning a substantially cylindrical body, or cylinder, whose height is smaller in comparison with its width or with its diameter.

In this case, the round insert 16, 18 (cf. FIG. 2) furthermore advantageously has the form of a sectionally offset cylinder, whose first section 24, which, in comparison with the second section 26, is for example wider, is provided with the receiver 20. The receiver 20 may in this case partially extend into the second section 26, which is offset with respect to the first section (cf. FIG. 2). Here, the geometry of the receiver 20 is freely selectable for the functioning as a receiver 20 for the pressure-exerting pin 22.

The peripheral shoulder 23 functions here as an anchor which axially fixes the inserts 16, 18 with respect to the encapsulated pump cover 8. By contrast, for tangential fixing of the inserts 16, 18, provision is made of shaped elements which are arranged over the periphery of the section 24 and which act tangentially, for example in the form of straight tooth flanks 25. Additionally or alternatively, it is also possible for provision to be made of curved shaped elements which equally ensure the fixing of the inserts 16, 18 in a tangential direction. Additionally or alternatively, it is also possible for two plane-parallel surfaces to be formed on the periphery of the first section 24.

Figure 3A:
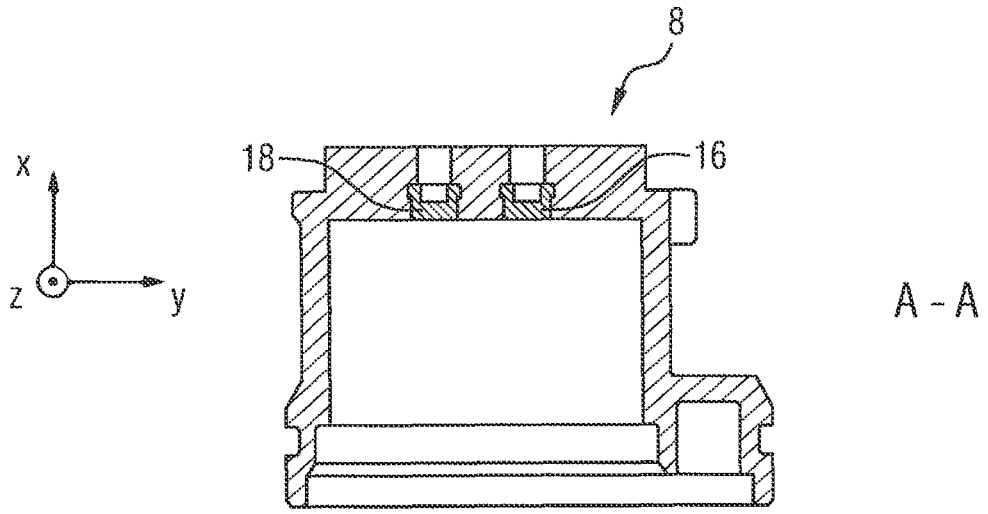
FIGS. 3A-3C show a sectional illustration, and two perspective illustrations, respectively, of a pump cover of the pump shown in FIG. 1.
Figure 3B:
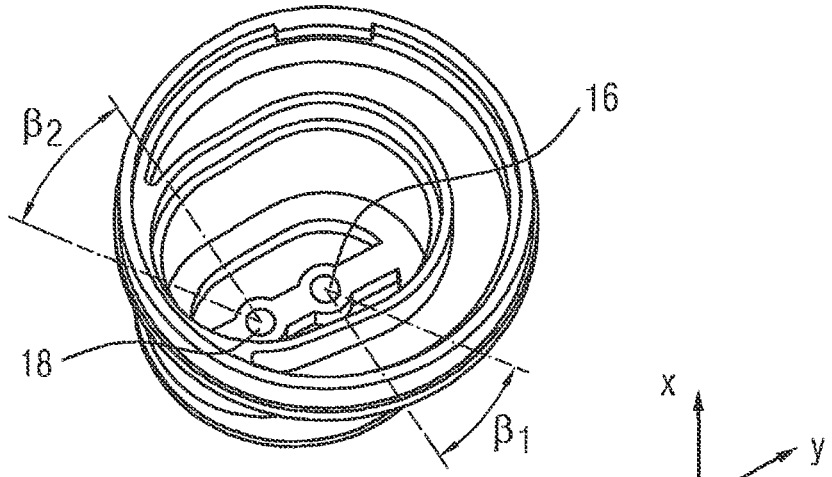
Figure 3C:
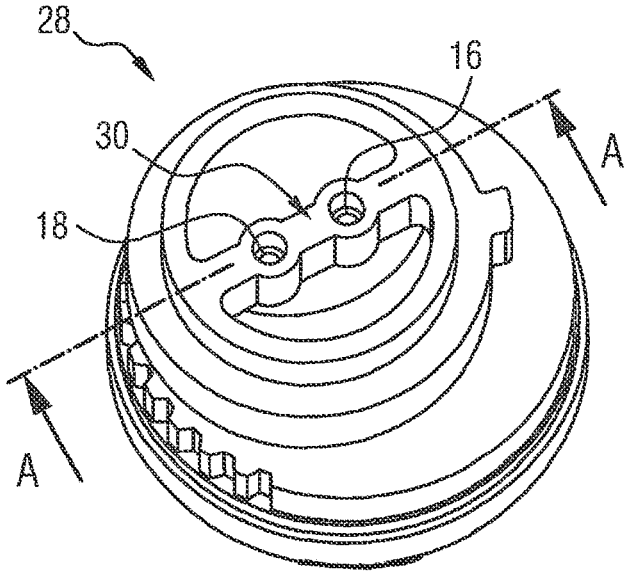

FIG. 3A illustrates a further sectional illustration of the above-described pump cover 8 along the section line A-A, wherein the two ceramic inserts 16, 18 with the associated abutments can be seen in the sectional illustrations, which abutments are also oriented or set at the angles $\beta_1$, $\beta_2$ relative to the second plane X-Y. FIGS. 3B and 3C also illustrate the advantageous aspects of the pump cover 8 formed as an injection molding, which has material savings at various locations, these advantageously contributing to saving of weight.

The lower one of the two perspective illustrations in FIGS. 3B and 3C illustrates the inlet 28 of the pump cover 8, via which inlet a fuel is sucked into the pump P. Here, a web 30, which is formed on the pump cover 8 and which divides the substantially circular inlet opening thereof, extends transversely or orthogonally to the longitudinal direction X-X. Here, the diameter of the inlet opening does not necessarily have to be understood in relation to a circular inlet opening, but rather as a contour circumscribing an inlet. The two inserts 16, 18 are accommodated in the web 30. Here, the web 30 is finely formed or encapsulated such that, owing to the encapsulated inserts 16, 18, the web contour is wave-like.

Although exemplary embodiments have been discussed in the above description, it should be noted that numerous modifications are possible. Furthermore, it should be noted that the exemplary embodiments are merely examples which are not intended to limit the scope of protection, the applications and the structure in any way. Rather, a person skilled in the art will take from the above description a guideline for implementation of at least one exemplary embodiment, wherein various modifications may be made, in particular with regard to the function and arrangement of the described components, without departing from the scope of protection as can be gathered from the claims and equivalent feature combinations.

The invention claimed is:

1. A screw-spindle pump (P) comprising:

a first screw spindle (2) and a second screw spindle (4), wherein the first screw spindle (2) is a drive spindle and the second screw spindle (4) is a running spindle that runs oppositely with respect to the first screw spindle (2); and a pump housing (6) configured to receive the first and second screw spindles (2, 4), wherein the first and second screw spindles (2, 4) form, together with at least the pump housing (6), delivery chambers (10), which move from a suction side (12) of the pump (P) to a pressure side (14) of the pump (P) as a consequence of a rotation of the first and second screw spindles (2, 4), wherein the pump housing (6) has a first abutment insert (16) configured as an abutment surface against which the first screw spindle (2) abuts and is thus supported and a second abutment insert (18) configured as an abutment surface against which the second screw spindle (4) abuts and is thus supported, and wherein at least one of the first and second abutment inserts (16, 18) is arranged so as to be angled ($\alpha_1$, $\alpha_2$) with respect to a first plane (X-Z) of the pump (P), so as to counteract operationally induced crossing of the first and second screw spindles (2, 4).

2. The pump as claimed in claim 1, wherein the first abutment insert (16) is arranged at a first angle ($\alpha_1$), and the second abutment insert (18) is arranged at a second angle ($\alpha_2$), with respect to the first plane (X-Z) of the pump (P), so as to counteract the operationally induced crossing.

3. The pump as claimed in claim 2, wherein the first angle ($\alpha_1$) is arranged oppositely in relation to the second angle ($\alpha_2$).

4. The pump as claimed in claim 3, wherein the first and second angles ($\alpha_1$, $\alpha_2$) are identical in terms of magnitude.

5. The pump according to claim 4, wherein at least one of the first and second abutment inserts (16, 18) is arranged so as to be angled ($\beta_1$, $\beta_2$) with respect to a second plane (X-Y) of the pump (P), which is orthogonal to the first plane (X-Z) of the pump (P), so as to counteract the operationally induced crossing.

6. The pump as claimed in claim 5, wherein the first abutment insert (16) is arranged at a third angle ($\beta_1$), and the second abutment insert (18) is arranged at a fourth angle ($\beta_2$), with respect to the second plane (X-Y), so as to counteract the operationally induced crossing.

7. The pump as claimed in claim 6, wherein the third angle ($\beta_1$) is arranged oppositely in relation to the fourth angle ($\beta_2$).

8. The pump as claimed in claim 7, wherein the third and fourth angles ($\beta_1$, $\beta_2$) are identical in terms of magnitude.

9. The pump as claimed in claim 1, wherein at least one of the first and second abutment inserts (16, 18) is of cuboidal, prismatic or round form.

10. The pump as claimed in claim 9, wherein at least one of the first and second abutment inserts (16, 18) has a peripheral shoulder (23) for axial fixing with respect to the pump housing (6).

11. The pump as claimed in claim 10, wherein at least one of the first and second abutment inserts (16, 18) has shaped elements (25) for tangential fixing with respect to the pump housing (6).

12. The pump as claimed in claim 11, wherein at least one of the first and second abutment inserts (16, 18) is made of a ceramic, a metal or a plastic.

13. The pump as claimed in claim 1, wherein the pump housing (6) further comprises a pump cover (8), in which the first abutment insert (16) and the second abutment insert (18) are arranged.

14. The pump as claimed in claim 13, wherein the first and second abutment inserts (16, 18) are arranged in the pump cover (8).

15. The pump as claimed in claim 14, wherein the pump housing (6) and/or the pump cover (8) are/is formed as an injection molding.

16. The pump as claimed in claim 15, wherein each of the first and second abutment inserts (16, 18) has a receiver (20) for receiving a pressure-exerting pin (22), to orient the first and second abutment inserts (16, 18) for encapsulation to set an angular setting of the first and second abutment inserts (16, 18) with respect to the longitudinal direction (X-X) and/or the transverse direction (Y-Y) of the pump (P).

17. A fuel delivery assembly comprising:

an electric motor; and the screw-spindle pump (P) as claimed in claim 1, wherein the screw-spindle pump (P) is driven by the electric motor.

* * * * *